US011197539B2

(12) United States Patent
Kaicker et al.

(10) Patent No.: US 11,197,539 B2
(45) Date of Patent: Dec. 14, 2021

(54) COSMETIC BRUSH FIBER WITH STAR-SHAPED CROSS SECTION

(71) Applicant: Anisa International, Inc., Atlanta, GA (US)

(72) Inventors: Anisa Telwar Kaicker, Atlanta, GA (US); NaTasha Miller, Atlanta, GA (US); Sarina Godin, Sandy Springs, GA (US)

(73) Assignee: Anisa International, Inc., Atlanta, GA (US)

( * ) Notice: Subject to any disclaimer, the term of this patent is extended or adjusted under 35 U.S.C. 154(b) by 0 days.

(21) Appl. No.: 16/773,523

(22) Filed: Jan. 27, 2020

(65) Prior Publication Data

US 2020/0154875 A1 May 21, 2020

Related U.S. Application Data

(63) Continuation-in-part of application No. 16/135,421, filed on Sep. 19, 2018, now Pat. No. 10,939,748,
(Continued)

(51) Int. Cl.
*A46B 9/02* (2006.01)
*A45D 40/26* (2006.01)
(Continued)

(52) U.S. Cl.
CPC ..... *A46D 1/0238* (2013.01); *A45D 33/00* (2013.01); *A45D 40/262* (2013.01); *A46B 9/021* (2013.01); *A46B 9/028* (2013.01); *A46D 1/04* (2013.01); *A45D 2200/10* (2013.01); *A46B 2200/1046* (2013.01)

(58) Field of Classification Search
CPC ..... A46D 1/0238; A46B 9/021; A46B 9/028; A46B 2200/1046; A45D 40/262
See application file for complete search history.

(56) References Cited

U.S. PATENT DOCUMENTS 2,317,485 A 4/1943 Rider
4,733,425 A * 3/1988 Hartel ..... A45D 40/265 132/218
(Continued)

FOREIGN PATENT DOCUMENTS

KR 101024089 12/2009
WO 2017160807 9/2017

OTHER PUBLICATIONS

Kaicker, Anisa Telwar; Notice of Allowance for U.S. Appl. No. 15/457,501, filed Mar. 13, 2017, dated Apr. 20, 2020, 5 pgs.
(Continued)

*Primary Examiner* — Randall E Chin
(74) *Attorney, Agent, or Firm* — Taylor English Duma LLP

(57) ABSTRACT

Example aspects of a brush assembly and a method for providing a brush assembly are disclosed. The brush assembly can comprise a plurality of elongate primary brush bristles, each of the primary brush bristles defining a star-shaped transverse cross section, each of the primary brush bristles defining five substantially parallel outer edges and five substantially parallel inner edges extending along a length of the primary brush bristle; and a ferrule attached to the plurality of primary brush bristles.

15 Claims, 8 Drawing Sheets

Related U.S. Application Data which is a continuation-in-part of application No. 15/457,501, filed on Mar. 13, 2017, now Pat. No. 10,736,410.

(60) Provisional application No. 62/308,852, filed on Mar. 15, 2016.

(51) Int. Cl.

| | |
|---|---|
| ***A46D 1/00*** | (2006.01) |
| ***A46D 1/04*** | (2006.01) |
| ***A45D 33/00*** | (2006.01) |

(56) References Cited

U.S. PATENT DOCUMENTS

| | | | | |
|---|---|---|---|---|
| 5,238,011 | A | 8/1993 | Gueret | |
| 5,567,072 | A | 10/1996 | Dunleavy et al. | |
| 6,033,143 | A * | 3/2000 | Gueret | A45D 34/045 401/126 |
| 6,210,059 | B1 | 4/2001 | Ramin et al. | |
| 6,367,114 | B1 | 4/2002 | Babkowski | |
| 7,752,702 | B2 | 7/2010 | Nakamura et al. | |
| 7,886,397 | B2 * | 2/2011 | Gueret | A46D 3/00 15/160 |
| 9,033,604 | B2 * | 5/2015 | Gueret | A45D 40/265 401/129 |
| 9,033,605 | B2 * | 5/2015 | Gueret | A46B 9/021 401/129 |
| 10,736,410 | B2 | 8/2020 | Kaicker | |
| 10,939,748 | B2 | 3/2021 | Kaicker | |
| 2004/0112400 | A1 | 6/2004 | Kurek | |
| 2008/0073968 | A1 | 3/2008 | Shiina | |
| 2009/0038094 | A1 * | 2/2009 | Kim | A45D 34/042 15/160 |
| 2009/0142125 | A1 | 6/2009 | Henrikson | |
| 2012/0301210 | A1 | 11/2012 | Sturgis et al. | |
| 2013/0291326 | A1 | 11/2013 | Mintel et al. | |
| 2013/0312207 | A1 | 11/2013 | Lim et al. | |
| 2015/0257525 | A1 | 9/2015 | Kang et al. | |
| 2017/0265637 | A1 | 9/2017 | Telwar | |
| 2019/0014896 | A1 | 1/2019 | Kaicker | |
| 2020/0297105 | A1 | 9/2020 | Kaicker | |

OTHER PUBLICATIONS

Kaicker, Anisa Telwar; Supplemental Notice of Allowance for U.S. Appl. No. 15/457,501, filed Mar. 13, 2017, dated Jun. 25, 2020, 6 pgs.

Kaicker, Anisa Telwar; Requirement for Restriction/Election for U.S. Appl. No. 16/135,421, filed Sep. 19, 2018, dated May 1, 2020, 8 pgs.

Kaicker, Anisa Telwar; Non-Final Office Action for U.S. Appl. No. 16/135,421, filed Sep. 19, 2018, dated Aug. 14, 2020, 25 pgs.

Kaicker, Anisa Telwar; Final Office Action for U.S. Appl. No. 15/457,501, filed Mar. 13, 2017, dated Aug. 16, 2019, 9 pgs. **Note: Copy not required as part of PTO records.

Kaicker, Anisa Telwar; Non-Final Office Action for U.S. Appl. No. 15/457,501, filed Mar. 13, 2017, dated Apr. 30, 2019, 23 pgs. **Note: Copy not required as part of PTO records.

Kaicker, Anisa Telwar; Requirement for Restriction/Election for U.S. Appl. No. 15/457,501, filed Mar. 13, 2017, dated Mar. 8, 2019, 7 pgs. **Note: Copy not required as part of PTO records.

Kaicker, Anisa Telwar; International Preliminary Report on Patentability for PCT Application No. PCT/US17/22261, filed Mar. 14, 2017, dated Sep. 27, 2018, 10 pgs.

Kaicker, Anisa Telwar; International Search Report and Written Opinion for PCT/US2017/022261, filed Mar. 14, 2017, dated Jun. 22, 2017, 12 pgs.

Kaicker, Anisa Telwar; Notice of Allowance for U.S. Appl. No. 16/135,421, filed Sep. 19, 2018, dated Nov. 10, 2020, 11 pgs.

Kaicker, Anisa Telwar; Non-Final Office Action for U.S. Appl. No. 16/899,038, filed Jun. 11, 2020, dated Sep. 20, 2021, 23 pgs.

* cited by examiner

COSMETIC BRUSH FIBER WITH STAR-SHAPED CROSS SECTION

CROSS-REFERENCE TO RELATED APPLICATIONS

The present application is a continuation-in-part of U.S. application Ser. No. 16/135,421, filed Sep. 19, 2018, now U.S. Pat. No. 10,939,748, which is a continuation-in-part of U.S. application Ser. No. 15/457,501, filed Mar. 13, 2017, now U.S. Pat. No. 10,736,410, which claims priority to U.S. Provisional Application No. 62/308,852, filed Mar. 15, 2016 both of which are hereby specifically incorporated by reference herein in their entireties.

BACKGROUND

Technical Field

This disclosure relates to fibers (aka bristles) such as used in cosmetic brushes or the like.

BRIEF SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

The present disclosure relates to a new fiber which has a triangular cross section, and which may be used as a substitute for animal hair with comparable pickup and other properties. The disclosure also relates to methods for providing same.

Generally described, the disclosure relates to a cosmetic brush, including a plurality of elongate brush bristles each having a triangular transverse cross section, such that each of said elongate brush bristles defines three substantially parallel edges along the length of each of said the bristles.

Another aspect of the present disclosure may include the cosmetic brush as noted above, wherein each of said plurality of elongate brush bristles includes a free end configured for the application of cosmetics, each of said free ends having a short tip.

Another aspect of the present disclosure may include the cosmetic brush as noted above, further comprising a plurality of elongate brush bristles each having a circular transverse cross section, said plurality of elongate brush bristles each having a circular transverse cross section being intermixed with said plurality of elongate brush bristles each having a triangular transverse cross section.

Another aspect of the present disclosure may include the cosmetic brush as noted above, wherein each of said plurality of elongate brush bristles having a triangular transverse cross section includes a triangular transverse cross section which defines an equiangular triangle.

Another aspect of the present disclosure may include the cosmetic brush as noted above, wherein each of said plurality of elongate brush bristles having a triangular transverse cross section includes a triangular transverse cross section which defines an equiangular triangle having sides each having a length being greater than or equal to 0.05 mm and less than or equal to 0.1 mm.

Another aspect of the present disclosure may include the cosmetic brush as noted above, wherein each of said plurality of elongate brush bristles having a triangular transverse cross section includes a wave.

Another aspect of the present disclosure may include the cosmetic brush as noted above, wherein each of said plurality of elongate brush bristles having a triangular transverse cross section is composed of extruded Polybutylene Terephthalate.

Another aspect of the present disclosure may include a method of providing a cosmetic brush for use in the application of cosmetics, said method comprising the steps of: A) extruding a plurality of elongate brush bristles each having a triangular transverse cross section, such that each of said elongate brush bristles defines three substantially parallel edges along the length of each of said the bristles; and B) combining said plurality of said bristles to provide a brush head for application of cosmetics.

Another aspect of the present disclosure may include the method as noted above, further comprising a step of extruding a plurality of elongate brush bristles each having a circular transverse cross section, and further comprising a step of intermixing said plurality of elongate brush bristles each having a circular transverse cross section with said plurality of elongate brush bristles each having a triangular transverse cross section.

Another aspect of the present disclosure may include the method as noted above, wherein each of said plurality of elongate brush bristles having a triangular transverse cross section is provided with an equiangular transverse cross section.

Another aspect of the present disclosure may include the method as noted above, wherein each of said plurality of elongate brush bristles having a triangular transverse cross section is provided with a triangular transverse cross section which defines an equiangular triangle having sides each having a transverse measured length being greater than or equal to 0.05 mm and less than or equal to 0.1 mm.

Another aspect of the present disclosure may include the method as noted above, wherein each of said plurality of elongate brush bristles having a triangular transverse cross section is provided with a wave.

Another aspect of the present disclosure may include the method as noted above, wherein each of said plurality of elongate brush bristles having a triangular transverse cross section is made of extruded Polybutylene Terephthalate.

Another aspect of the present disclosure may include the method as noted above, wherein each of said plurality of elongate brush bristles having a triangular transverse cross section is provided with a short tip by dipping one of its tips in a solution including sodium hydroxide.

Another aspect of the present disclosure may include a method of providing a cosmetic brush for use in the application of cosmetics, said method comprising the steps of: A) extruding a plurality of elongate brush bristles each having a triangular transverse cross section, such that each of said elongate brush bristles defines three substantially parallel edges along the length of each of said the bristles; B) soaking said plurality of elongate brush bristles each having a triangular transverse cross section in water; C) dipping one of the tips of each said plurality of elongate brush bristles of step B in a solution including sodium hydroxide so as to provide a short tip; and D) combining said plurality of said bristles to provide a brush head for application of cosmetics, such that said short tips are commonly oriented and free.

Another aspect of the present disclosure may include the method as noted above, further comprising a step of extruding a plurality of elongate brush bristles each having a circular transverse cross section, and further comprising a step of intermixing said plurality of elongate brush bristles each having a circular transverse cross section with said plurality of elongate brush bristles each having a triangular transverse cross section.

Another aspect of the present disclosure may include the method as noted above, wherein each of said plurality of elongate brush bristles having a triangular transverse cross section is provided with an equiangular transverse cross section.

Another aspect of the present disclosure may include the method as noted above, wherein each of said plurality of elongate brush bristles having a triangular transverse cross section is provided with a triangular transverse cross section which defines an equiangular triangle having sides each having a transverse measured length being greater than or equal to 0.05 mm and less than or equal to 0.1 mm.

Another aspect of the present disclosure may include the method as noted above, wherein each of said plurality of elongate brush bristles having a triangular transverse cross section is provided with a wave.

Another aspect of the present disclosure may include the method as noted above, wherein in step "B", said plurality of elongate brush bristles are soaked in water for 10 minutes at room temperature.

Also disclosed is a cosmetics brush comprising a plurality of elongate primary brush fibers, each of the primary brush fibers defining a rectangular transverse cross section, each of the primary brush fibers defining four substantially parallel edges along a length of the primary brush fiber; and a ferrule attached to the plurality of primary brush fibers.

Another aspect of the cosmetics brush can comprise a plurality of primary brush fibers, each of the primary brush fibers defining four substantially parallel edges along a length of the primary brush fiber, each of the primary brush fibers defining a quadrangular transverse cross section, the quadrangular transverse cross section defining four concave sides; and a ferrule attached to the plurality of primary brush fibers.

A method for providing a cosmetics brush can comprise the steps of providing an extrusion plate, the extrusion plate defining a plurality of extrusion holes, each of the extrusion holes defining a quadrangular shape; extruding a material through the extrusion plate to form a plurality of primary brush fibers, each of the primary brush fibers defining a quadrangular transverse cross section; and attaching a first end of each of the primary brush fibers to a ferrule.

A brush assembly is disclosed, the brush assembly comprising a plurality of elongate primary brush bristles, each of the primary brush bristles defining a star-shaped transverse cross section, each of the primary brush bristles defining five substantially parallel outer edges and five substantially parallel inner edges extending along a length of the primary brush bristle; and a ferrule attached to the plurality of primary brush bristles.

Also disclosed is a method for providing a brush assembly, the method comprising providing an extrusion plate, the extrusion plate defining a plurality of extrusion holes, each of the extrusion holes defining a star shape; extruding a material through the extrusion plate to form a plurality of primary brush bristles, each of the primary brush bristles defining a star-shaped transverse cross section; and attaching a first end of each of the primary brush bristles to a ferrule.

Other aspects and advantages of the present disclosure will become obvious to the reader and it is intended that these objects and advantages are within the scope of the present invention.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

ELEMENT LIST

Here is a list of the various elements:

10 Brush Assembly
20 Bristles
21 Exemplary Bristle
30 Ferrule
40 Handle
100 Extrusion Plate
102 Extrusion Holes
802 Straight Sides of Square
804 Interior Angles of Square
806 Edges of Quadrangular Bristle
808 Restrained End of Quadrangular Bristle
1110 Free End of Quadrangular Bristle
1150 Cosmetics Brush
$L_1$ Length of Straight Sides
$D_1$ Diagonal of Square
902 Concave Sides of Quadrangle
904 Interior Angles of Quadrangle
906 Edges of Quadrangular Bristle
908 Restrained End of Quadrangular Bristle
1210 Free End of Quadrangular Bristle
$D_2$ Diagonal of Quadrangle
1110 Center Axis
1122 Star Prism Bristle
$L_2$ Length of Star Prism Bristle
1123 Pentagrammic Prism Bristle
1125 Star-Shaped Transverse Cross Section
1130 Corner Vertex
θ Interior Vertex Angle
1140 Side of Star-Shaped Transverse Cross Section
$L_3$ Length of Side
1150 Outer Edge
1155 Inner Edge
1160 Bristle wall
1170 First End of Bristle
1175 Free End
1180 Second End of Bristle
1185 Restrained End
1210 Bundle of Bristles
1220 Short Tip

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION AND BEST MODE OF IMPLEMENTATION

Figure 1:
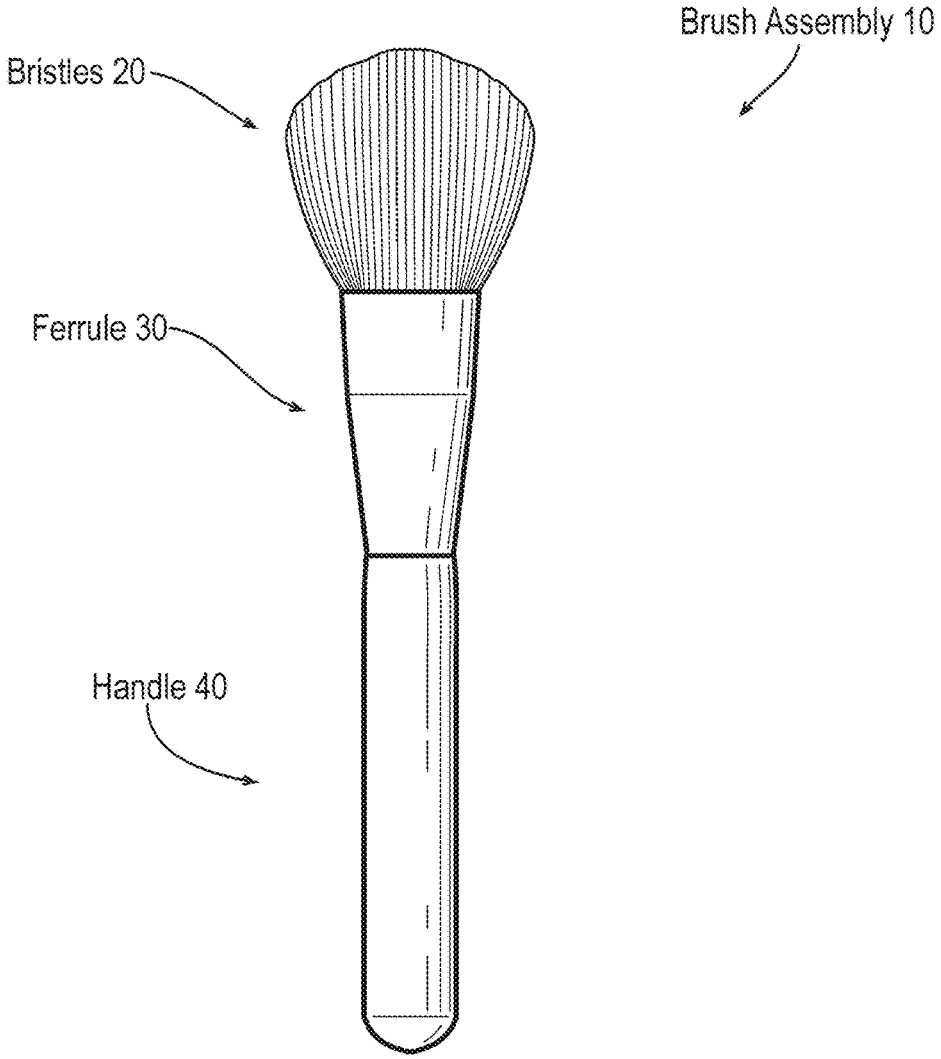
FIG. 1 illustrates an example brush assembly 10, including bristles 20, a ferrule 30, and a handle 40. The bristles 20 include multiple individual elongate bristle elements discussed in more detail later. The ferrule 30 attaches the bristles 20 relative to the handle 40, such that a user (not shown) can grasp the handle 40 and apply cosmetic product to the bristles 20, and thereafter from the bristles 20 to the user's face (not shown).

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

The present disclosure now will be described more fully hereinafter with reference to the accompanying drawings, in which some, but not all embodiments of the disclosure are shown. The invention may be embodied in many different forms and should not be construed as limited to the embodiments set forth herein; rather, these embodiments are provided so that this disclosure will satisfy applicable legal requirements Like numbers refer to like elements throughout.

Reference is now made to the figures, in which like elements indicate like elements throughout the several views General Operating Environment As will be seen, discussion will be made herein regarding bristles for use in cosmetic brushes of the like, said bristles having a triangular cross section. Reference is made to FIG. 1, which illustrates an example brush assembly 10, including bristles 20, a ferrule 30, and a handle 40. The bristles 20 include multiple individual elongate bristle elements. The ferrule 30 attaches the bristles 20 relative to the handle 40, such that a user (not shown) can grasp the handle 40 and apply cosmetic product to the bristles 20, and thereafter from the bristles 20 to the user's face (not shown).

The Triangular Fiber (Aka Triangular Bristle)

Figure 2:
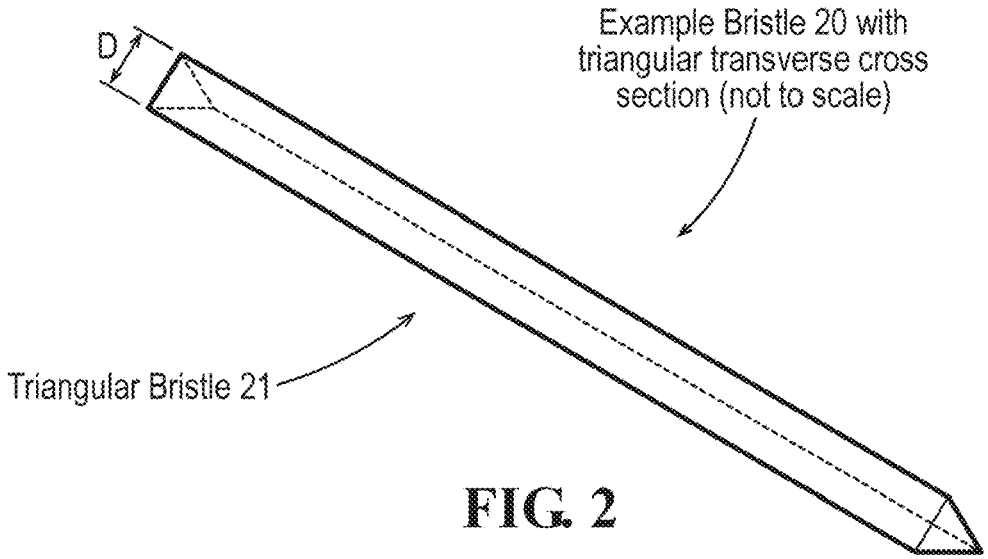
FIG. 2 illustrates an example bristle 20 (aka fiber 20) with a triangular transverse cross section. This figure is not to scale. In this embodiment the triangular transverse cross section is that of an equiangular triangle. It should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20. These bristles are contemplated for use in the bristles 20 noted above.

Reference is now made to FIG. 2, which illustrates an example triangular bristle 21 (aka triangular fiber 21) with a triangular transverse cross section. This figure is not to scale. In this embodiment the triangular transverse cross section is that of an equiangular triangle. It should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20. These bristles are contemplated for use in the bristles 20 noted above.

Uses of the Triangular Bristles

Contemplated herein is the use of a triangular bristle such as 21 in a cosmetic brush such as brush assembly 10 in FIG. 1, to apply cosmetic products to the skin.

Mixture with Other Bristles

Under one configuration, the triangular section fibers 21 may be used alone, that is, no other types of bristles may be used in the bristles 20.

Under another configuration the triangular section fibers 21 may be used in a blend of fibers which might contain a percentage of triangular section fibers and a percentage of circular transverse section PBT fibers (such as are commonly used for makeup brushes).

Advantages of the Triangular Bristles

The cosmetic industry is getting more and more involved in environmentally friendly manufacture/products and animal cruelty issues.

For this reason, the inventors contemplate making brushes with PBT, instead of animal hair. The challenge of doing so is that the animal hair provides more powder pick up compared to conventional PBT, because the animal hair has a texture on the surface in part due to the presence of cuticles. Extruded PBT does not have such a surface texture.

The triangular bristles increase the powder pick up power of the brush, because the shape of each bristle (three parallel edges along the length of the bristle) is capable of scratching the surface of the press powder product (the triangular fiber shape "scratches" more compared to a circular section fiber).

Said another way, the triangular fiber can be used for animal hair substitution because of its ability of picking up powder better than the commonly used circular section PBT Dimensions of the Triangular Bristles Reference is again made to FIG. 2, which illustrates an example bristle 20 (aka fiber 20) with a triangular transverse cross section. This figure is not to scale. In this embodiment the triangular transverse cross section is that of an equiangular triangle. It should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20.

The sizes of the dimension D is contemplated to include the following lengths 0.05 mm, 0.06 mm, 0.07 mm, 0.08 mm 0.09 mm, and 0.1 mm. Another way of saying this is that the triangular transverse cross sections which define an equiangular triangle have sides each having a transverse measured length being greater than or equal to 0.05 mm and less than or equal to 0.1 mm. Each of these sizes would provide different advantages.

Composition of Fibers

The composition of the fibers is in one configuration to be PBT (Polybutylene Terepthalate).

However, other materials and better resins are contemplated.

Some cosmetic filaments are made with Nylon, although the elasticity and retention of the material is not as good as PBT.

DuPont has two cosmetic filaments named Sorona and Natrafil. The two are not PBT and they could be extruded in a triangular section.

Extrusion of Fibers

The manufacture of the fibers is done by PBT extrusion techniques such as known in the art, such as using a triangular plate tooling to achieve the triangular PBT section of the fiber.

A "wave" can be provided in the fiber and is achieved with a conventional crimping method.

The Tipping Process as Applied to Round Bristles

Disclosed is the use of a NaOH solution used to dip the tips of the hair into to eat away at the tips which gives the fiber a softer feel on the face. This may be understood as providing a "short" tip to the fiber/bristle.

In one embodiment of the present disclosure, a chemical tipping process is used to provide similar short tips to the synthetic fiber. Here is a description of the "short tip" tipping process for the following two types of PBT fibers having round cross sections:

0.05 mm diameter, 40 mm long 0.07 mm diameter, 40 mm long

Hair Dimension 0.05 mm Diameter, 40 mm Long

Figure 7:
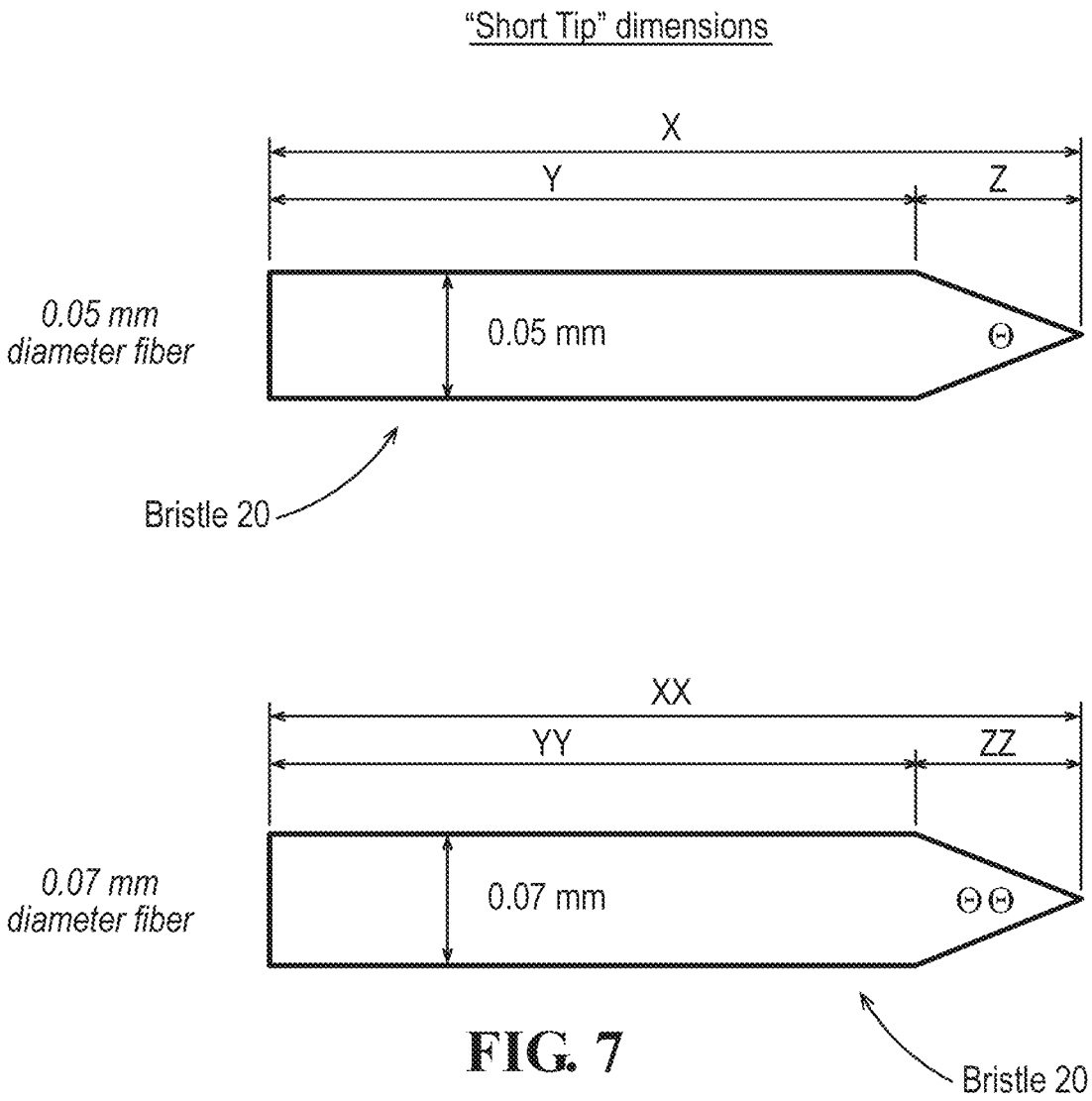
FIG. 7 shows various "short" tip dimensions for PBT round cross section fibers/bristles.

Reference is made to FIG. 7 Here are certain specifications for this diameter fiber and its related tipping processes:

Tip type: Short Tip

Tipping solution: NaOH (Sodium hydroxide), having a concentration of 44.5+/−2, diluted with water.

Concentration: 44.5+/−2 percent

Temperature: 135'C+/−2 degrees C.

Time 17 min+/−1 min

Length tip is dipped into solution: 5 mm~6 mm+/−1 mm

Final tip length: 1 mm+/−0.2 mm

The process is as follows. A PBT fiber having a dimension of 0.06 mm diameter and 40 mm long is suspended from above a tipping solution such that a downwardly extending end of the fiber can be dipped into the solution. The tipping solution is NaOH (sodium hydroxide) having a concentration of 44.5+/−2, diluted with water, at a temperature of 135'C+/−2. The downwardly extending end of the fiber is dipped into the tipping solution for about 17 min+/−1 min. The length of the tip which is dipped into solution is 5 mm~6 mm+/−1 mm. The final tip length is approximately 1 mm+/−0.2 mm. Said another way, the solution removes approximately 4 mm and 1 mm is left. This is the Z dimension in FIG. 7.

Hair Dimension 0.07 mm Diameter, 40 mm Long

Reference is made to FIG. 7. Here are certain specifications for this diameter fiber and its related tipping processes:

Tip type: Short Tip

Tipping solution: NaOH (Sodium hydroxide), having a concentration of 44.5+/−2, diluted with water.

Concentration: 44.5+/−2 percent

Temperature: 132'C+/−2 degrees C.

Time: 17 min+/−1 min

Length tip is dipped into solution: 5 mm~6 mm+/−1 mm

Final tip length: 1 mm+/−0.2 mm

The process is as follows. A PBT fiber having a dimension of 0.075 mm diameter and 40 mm long is suspended from above a tipping solution such that a downwardly extending end of the fiber can be dipped into the solution. The tipping solution is NaOH (sodium hydroxide) having a concentration of 44.5+/−2, diluted with water, at a temperature of 132 degrees C.+/−2 degrees. The downwardly extending end of the fiber is dipped into the tipping solution for about 17 min+/−1 min. The length of the tip which is dipped into solution is 5 mm~6 mm+/−1 mm. The final tip length is approximately 1 mm+/−0.2 mm. Said another way, the solution removes approximately 4 mm and 1 mm is left. This is the ZZ dimension in FIG. 7

The Tipping Process as Applied to Triangular Bristles

As noted above NaOH is a solution used to dip the tips of the round bristles into to eat away at the tips which gives the fiber a softer feel on the face.

For the triangular bristles, it's a little different.

A normal PBT fiber bundle (with circular cross sections) is dense, while the triangular fiber bundle is less dense, due to the shape of the fiber.

With less density, the fibers more easily soak with and absorb the NaOH solution. So there is a need to better control the process to avoid the triangular fiber bundle absorbing too much NaOH solution. This is done by soaking the material in water before it is "tipped".

The bundle is soaked in water for 10 minutes at room temperature. Otherwise the tipping process for the round bristles is used.

Quadrangular Bristles

Figure 8A:
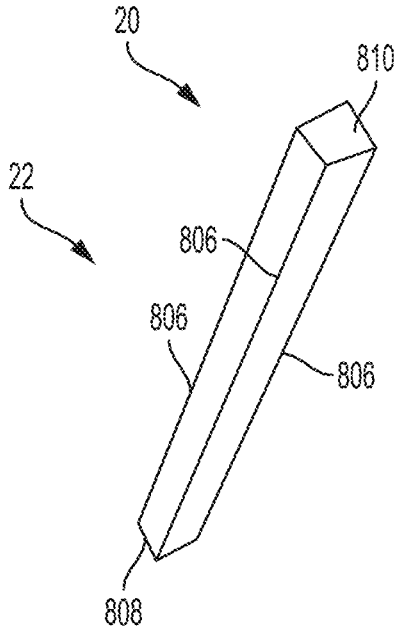
FIG. 8A is a perspective view of a quadrangular brush fiber, according to an aspect of the present disclosure.
Figure 8B:
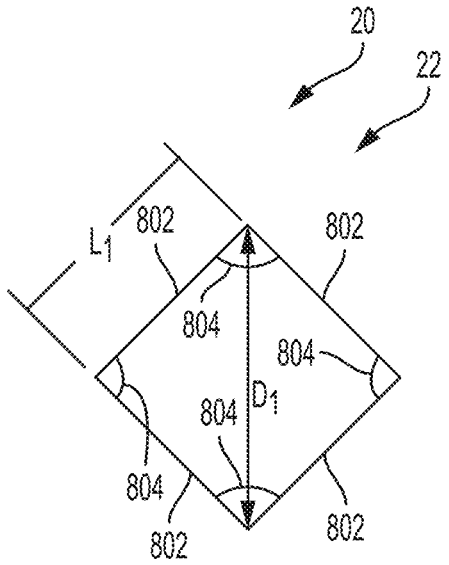
FIG. 8B is an end view of the quadrangular brush fiber of FIG. 8A.

In other example aspects, the bristles 20 can be quadrangular bristles 22, wherein each quadrangular bristle 22 defines a quadrangular transverse cross section. A quadrangle can be defined as a four-sided plane figure. FIGS. 8A and 8B illustrate a first example of a quadrangular bristle 22 (aka a quadrangular fiber 22) defining a substantially rectangular transverse cross-section. In example aspects, the rectangular transverse cross-section can be that of a square, as shown in FIG. 8B. It should be understood that a square is a rectangle defining four straight sides 802 of equal length and four interior angles 804 of equal dimension. In example aspects, each of the sides 802 can define a length $L_1$ between about 0.03 mm and 0.08 mm, and more specifically between about 0.04 mm and 0.06 mm. In another more specific aspect, the length $L_1$ of each side can be about 0.05 mm. As such, the diagonal $D_1$ of the square can be between about 0.04 mm and 0.11 mm, and more specifically, between about 0.06 mm and 0.09 mm. In a more specific aspect, the diagonal $D_1$ can be about 0.07 mm. The interior angles 804 of the square can add up to about 360°, and each angle can be about 90°. Furthermore, as shown in FIG. 8A, the quadrangular bristles 22 can define four substantially parallel edges 806 extending along a length of the quadrangular bristle 22, as illustrated, from a restrained end 808 to a free end 1110. The restrained end 808 and free end 1110 are further described below.

Figure 8C:
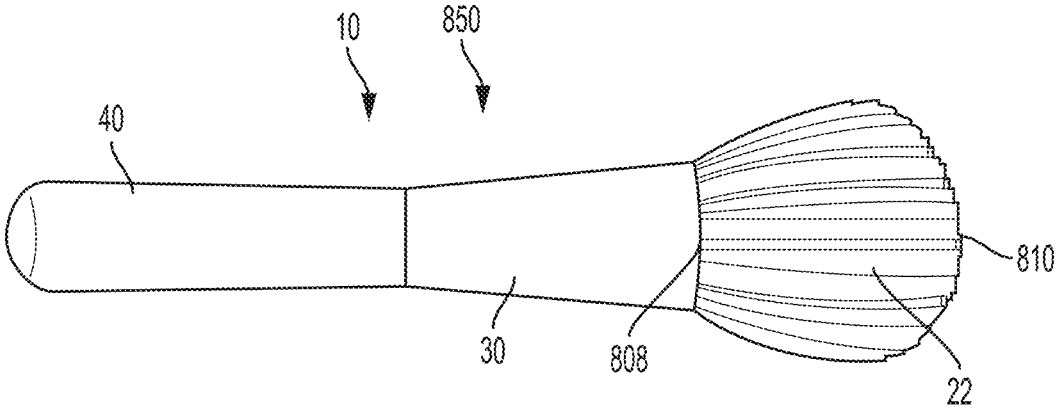
FIG. 8C is a side view of cosmetics brush, according to an aspect of the present disclosure, comprising a bundle of the quadrangular brush fibers of FIG. 8A, a ferrule, and handle.

FIG. 8C illustrates another aspect of the brush assembly 10, according to the present disclosure. The brush assembly 10 can be, for example, a cosmetics brush 1150. The cosmetics brush 1150 can comprise a bundle of the quadrangular bristles 22 coupled to the ferrule 30. In example aspects, the ferrule 30 can be coupled to the handle 40. As shown, each of the quadrangular bristles 22 can define the restrained end 808 attached to the ferrule 30 and the free end 1110 distal from the ferrule 30. In some aspects, the quadrangular bristles 22 can define a short tip at the free end 1110. The process for forming a short tip is explained in further detail below. According to example aspects, cosmetics can be applied to the free ends 1110 of the quadrangular bristles 22.

Figure 9A:
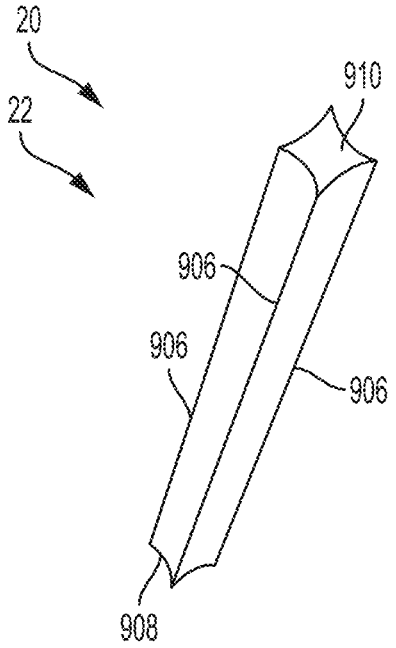
FIG. 9A is a perspective view of the quadrangular brush fiber, according to another aspect of the present disclosure.
Figure 9B:
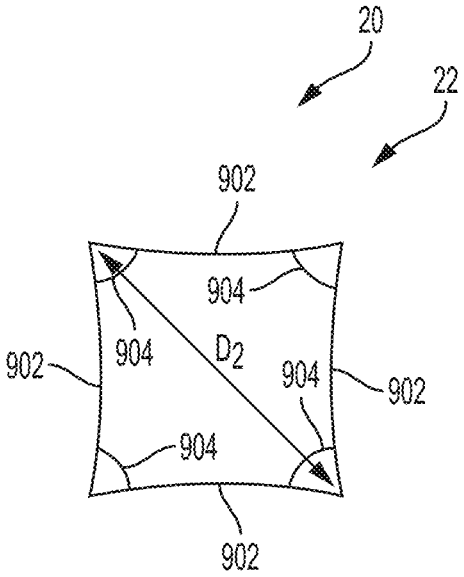
FIG. 9B is an end view of the quadrangular brush fiber of FIG. 9A.

FIGS. 9A and 9B illustrate another example aspect of a quadrangular bristle 22, also defining a quadrangular transverse cross section. As shown in FIG. 9B, the quadrangular transverse cross section of the quadrangular bristle 22 of the current aspect can define four concave sides 902 and four interior angles 904. In example aspects, a diagonal $D_2$ of the quadrangle can be between about 0.04 mm and 0.11 mm, and more specifically, between about 0.06 mm and 0.07 mm. In a more specific aspect, the diagonal $D_2$ can be about 0.07 mm. In example aspects, as shown, the each of the four concave sides 902 can be of equal length, and each of the angles 904 of the quadrangle can be less than 90°. Each angle 904 can also be equal to each other. As shown in FIG. 9A, the quadrangular bristle 22 can further define four substantially parallel edges 906 extending along a length of the quadrangular bristle 22.

Each of the quadrangular bristles 22 of FIGS. 9A and 9B can define a restrained end 908 that can be attached to the ferrule 30 (shown in FIG. 8C) and a free end 1210 opposite the restrained end 908. Some aspects of the quadrangular bristles 22 can also define a short tip at the free end 1210.

Still other aspects of the quadrangular bristles 22 can define a quadrangular transverse cross section of another shape. For example, other aspects of the quadrangular transverse cross section can define a diamond, kite, rhombus, trapezoid, a quadrangle with convex sides, a quadrangle with sides of varying length, or any other suitable quadrangular shape. Referring generally to all aspects of the quadrangular bristles 22, some example aspects of the cosmetic brush 1150 (shown in FIG. 8) can intermix the quadrangular bristles 22 with rounded bristles (not shown) defining a circular or rounded transverse cross section. In such an aspect, the quadrangular bristles 22 can be referred to as primary bristles or fibers, and the rounded bristles can be referred to as secondary bristles or fibers. Also referring generally to all aspects of the quadrangular bristles 22, some or all of the quadrangular bristles 22 can define a wave pattern formed by a crimping process during manufacturing.

The Extrusion Process as Applied to Quadrangular Bristles

Similar to a bundle of the triangular bristles 21 described above, the quadrangular bristles 22 can be manufactured by extruding the PBT material through an extrusion plate 100.

Figure 10:
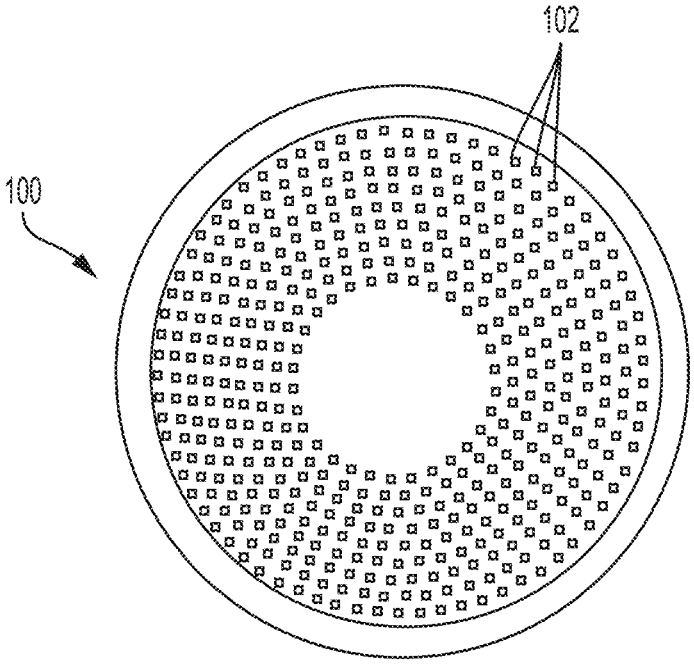
FIG. 10 is a cross sectional view of an extrusion plate, according to an aspect of the present disclosure.

In other aspects, the quadrangular bristles 22 can be formed from another material, such as, for example polybutylene terephthalate, polyethylene terephthalate (PET), nylon, Sorona®, and Natrafil®, as mentioned above. FIG. 10 illustrates another example aspect of the extrusion plate 100. As shown, the extrusion plate 100 can define a plurality of the extrusion holes 102, and each of the extrusion holes 102 can define a quadrangular shape. In example aspects, such as the depicted aspect, the quadrangular shape of each of the extrusion holes 102 can define concave sides of equal length, such that the extrusion plate 100 can form the quadrangular bristles 22 shown in FIGS. 9A and 9B. In other aspects, as shown in FIG. 10, the quadrangular shape of each extrusion hole 102 can define a square, such that the extrusion plate 100 can form the quadrangular bristles 22 shown in FIGS. 8A and 8B. In still other aspects, the extrusion holes 102 can define a different quadrangle shape, such as, for example, a quadrangle with convex sides, a quadrangle with sides of varying lengths, etc.

The Tipping Process as Applied to Quadrangular Bristles

The tipping process can involve dipping the free ends 1110,1210 of the quadrangular bristles 22 in a chemical solution that can eat away at the quadrangular bristles 22 to create a more pointed free end 1110,1210. For example, the chemical solution can be a sodium hydroxide (NaOH) solution. In some aspects, to prevent the bundle of quadrangular bristles 22 from absorbing too much of the NaOH solution, the bundle of quadrangular bristles 22 can be soaked in water before performing the tipping process. In example aspects, the bundle of quadrangular bristles 22 can be soaked in room-temperature water for about 10 minutes. In other aspects, the bundle of quadrangular bristles 22 can be soaked in water that is warmer or cooler than room temperature and/or can be soaked for more or less than 10 minutes. In still other aspects, the bundle of quadrangular bristles 22 may not be soaked in the water before performing the tipping process.

Bristles with Star-Shaped Cross-Section

Figure 11:
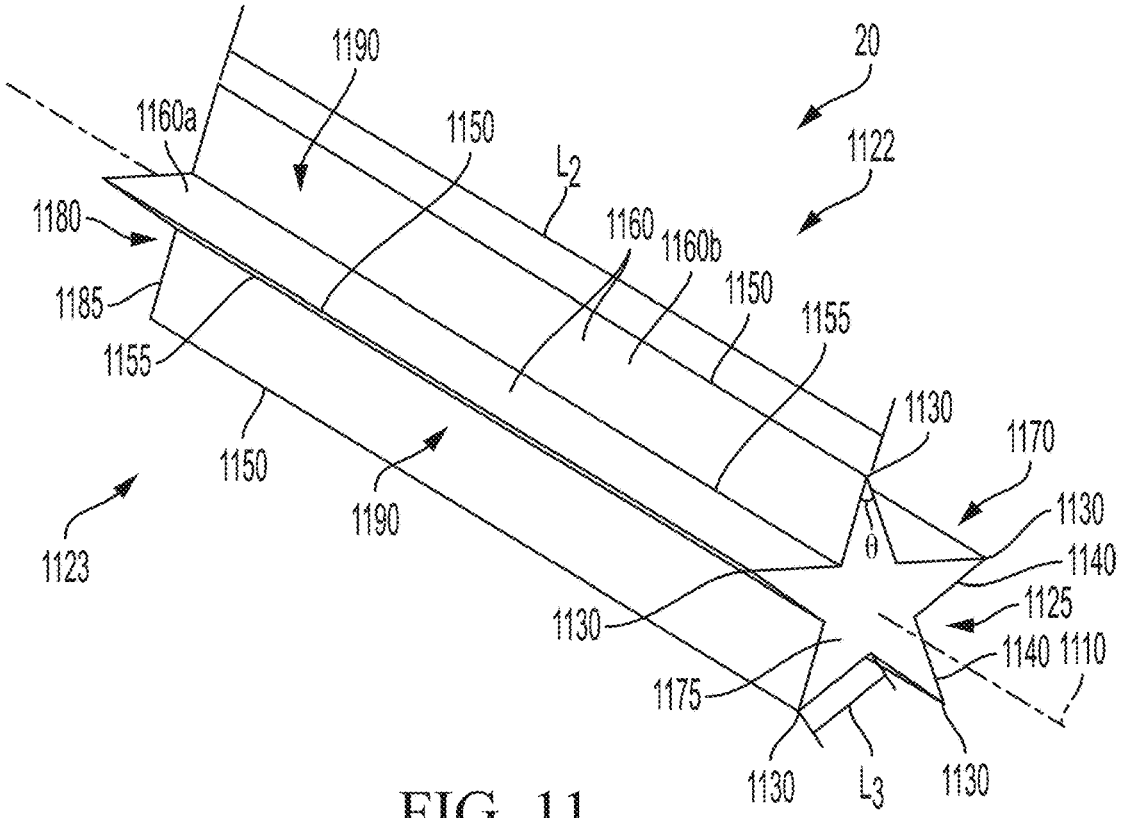
FIG. 11 is a perspective view of a brush fiber with a star-shaped cross-section, according to an aspect of the present disclosure.

In other example aspects, the bristles 20 can be star prism bristles or fibers, wherein each star prism bristle or fiber can define a star-shaped transverse cross section. A star can be defined as a plane figure having five corner vertices and ten sides. FIG. 11 illustrates a first example of a star prism bristle 1122 defining a substantially star-shaped transverse cross-section 1125. The star-shaped transverse cross section 1125 of the star prism bristle 1122 can define five corner vertices 1130 and ten sides 1140. In example aspects, the star-shaped transverse cross-section 1125 can be that of a pentagram, as shown. As such, in some aspects, each of the star prism bristles 1122 can be a pentagrammic prism bristle 1123. It should be understood that a pentagram is a star defining ten straight sides 1140 of equal length and five interior vertex angles θ of equal dimension. In example aspects, each of the sides 1140 can define a length $L_3$ between about 0.015 mm and 0.040 mm. For example, in a particular aspect, the length $L_3$ can be about 0.018 mm. In another aspect, the length $L_3$ can be about 0.025 mm. In another aspect, the length $L_3$ can be about 0.036 mm. In still other aspects, the length $L_3$ can be greater or smaller than the stated range. Furthermore, according to example aspects, each of the interior vertex angles θ can be formed at a corresponding one of the corner vertices 1130 and can be about 36°. In other aspects, however, the sides 1140 of each star prism bristle 1122 may define varying lengths and/or varying interior vertex angles θ.

As shown in FIG. 11, each of the star prism bristles 1122 can define five substantially parallel outer edges 1150 extending along a length $L_2$ of the star prism bristle 1122 and five substantially parallel inner edges 1155 extending along the length $L_2$ of the star prism bristle 1122. Each of the inner edges 1155 can be positioned generally between and inward of a corresponding pair of the outer edges 1150, relative to a center axis 1110 extending through a center of the star prism bristle 1122. A bristle wall 1160 can be formed between each adjacent pair of outer and inner edges 1150, 1155 and can extend from a first end 1170 of the star prism bristle 1122 to a second end 1180 of the star prism bristle 1122, as shown. As such, a pair of adjacent bristle walls 1160*a,b* can be formed between each adjacent pair of outer edges 1150. Each of the bristle walls 1160 can be angled inward relative to the center axis 1110, such that each of the pairs of adjacent bristle walls 1160*a,b* can meet at a corresponding one of the inner edges 1155 and can define an elongated indentation 1190 therebetween. The elongated indentation 1190 can extend along the length $L_2$ of the star prism bristle 1122, as shown. According to example aspects, each of the elongated indentations 1190 can define a substantially triangular prism shape overall and a substantially triangular cross sectional shape. In some aspects, each of the bristle walls 1160 can be substantially planar, while in other aspects, each of the bristle walls 1160 may not be substantially planar. Each of the outer edges 1150 and inner edges 1155 can be configured to extend from the first end 1170 of the star prism bristle 1122 to the second end 1180 of the star prism bristle 1122, as shown. In some aspects, the first end 1170 of the bristle 1122 can be a free end 1175 and the second end 1180 of the bristle 1122 can be a restrained end 1185, as described in further detail below.

Figure 12:
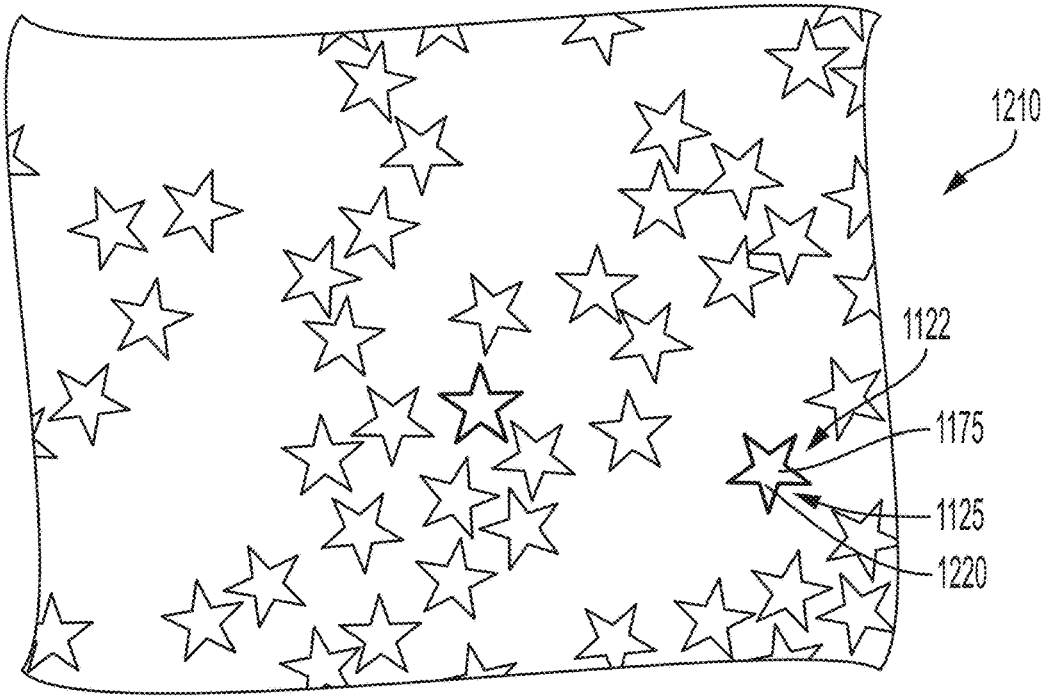
FIG. 12 is an end view of a plurality of the brush fibers of FIG. 11.

Referring to FIG. 12, according to example aspects, a plurality of the star prism bristles 1122 can grouped together form a bundle 1210. In some aspects, the bundle 1210 of star prism bristles 1122 can be couple to the ferrule 30 (shown in FIG. 1). The bundle 1210 of bristles 1122 and the ferrule can define the brush assembly 10 (shown in FIG. 1), which can be, for example, a cosmetics brush. In example aspects, the brush assembly 10 can further comprise the handle 40 (shown in FIG. 1) coupled to the ferrule 30. Each of the star prism bristles 1122 can define the restrained end 1185 (shown in FIG. 11) attached to the ferrule 30 and the free ends 1175 thereof can be distal to the ferrule 30. In some aspects, each of the star prism bristles 1122 can define a short tip 1220 at the free end 1175 thereof. The process for forming a short tip 1220 is explained in further detail below. According to example aspects, cosmetics can be applied to the free ends 1175 of the star prism bristles 1122.

Other aspects of the star prism bristles 1122 can define a star-shaped transverse cross section 1125 having a shape other than pentagonal. For example and without limitation, other aspects of the star-shaped transverse cross section 1125 can define a hexagram, heptagram, octagram, three-pointed star, four-pointed star, or any other suitable star shape. Referring generally to all aspects of the star prism bristles 1122, some example aspects of the bundle 1210 can intermix the star prism bristles 1122 with the triangular bristles 21 (shown in FIG. 2), rounded bristles (not shown) defining a circular or rounded transverse cross section, the quadrangular bristles 22 (shown in FIG. 8A) defining a rectangular transverse cross section, and/or bristles defining any other suitable transverse cross-sectional shape. In such an aspect, the star prism bristles 1122 can be referred to as primary bristles or fibers, and the bristles defining another transverse cross-sectional shape can be referred to as secondary bristles or fibers, tertiary bristles or fibers, and so on. For example, in an aspect of the brush assembly 10 comprising the star prism bristles 1122, the triangular bristles 21, and quadrangular bristles 22, the star prism bristles 1122 can be referred to as primary bristles, the triangular bristles 21 can be referred to as secondary bristles, and the quadrangular bristles 22 can be referred to as tertiary bristles. Also referring generally to all aspects of the star prism bristles 1122, some or all of the star prism bristles 1122 in the bundle 1210 can define a wave pattern formed by a crimping process during manufacturing. In aspects of the bundle 1210 also comprising bristles having another transverse cross-sectional shape, some or all of those bristles may also define a wave pattern formed by a crimping process during manufacturing.

The Extrusion Process as Applied to Star Prism Bristles

Figure 3:
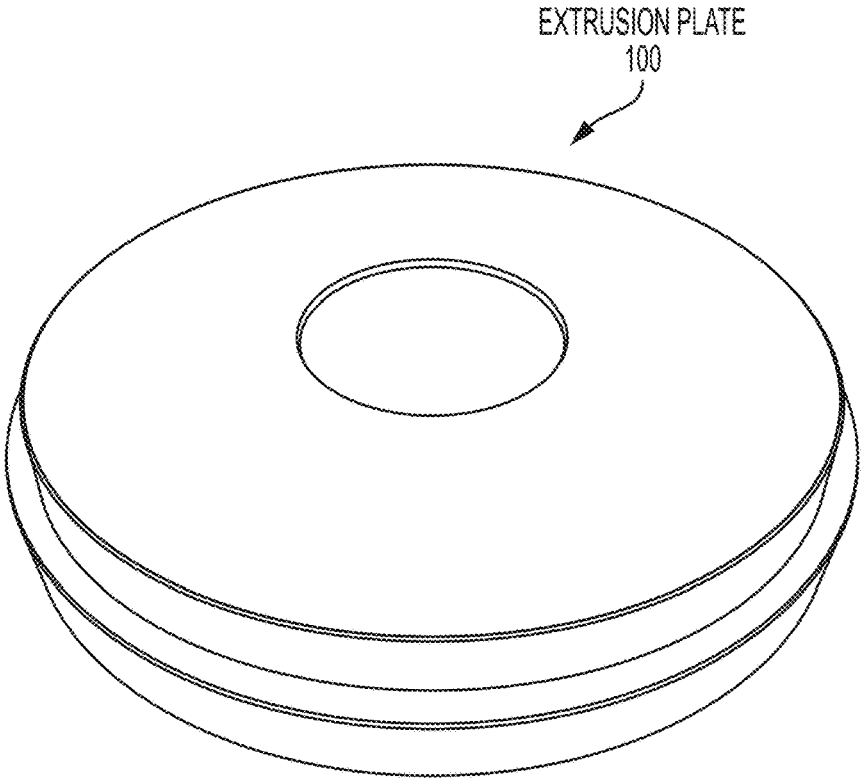
FIG. 3 illustrates an extrusion plate 100.
Figure 4:
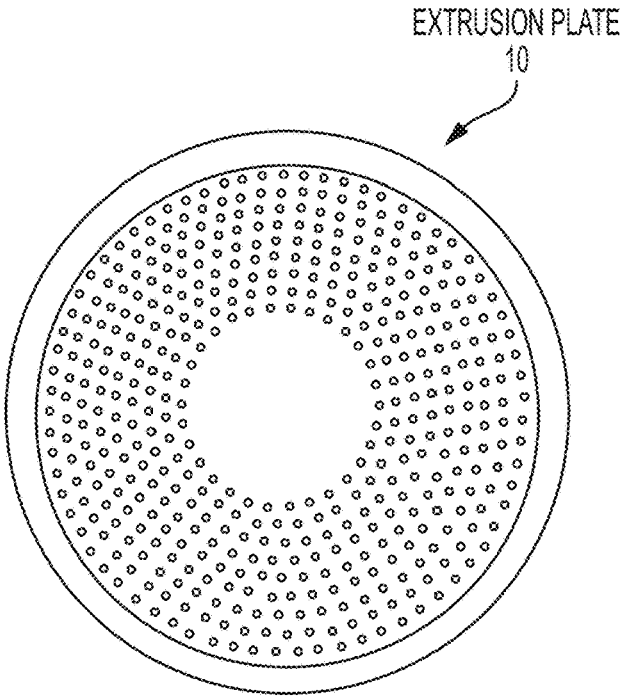
FIG. 4 illustrates the inlet side of the extrusion plate 100.
Figure 5:
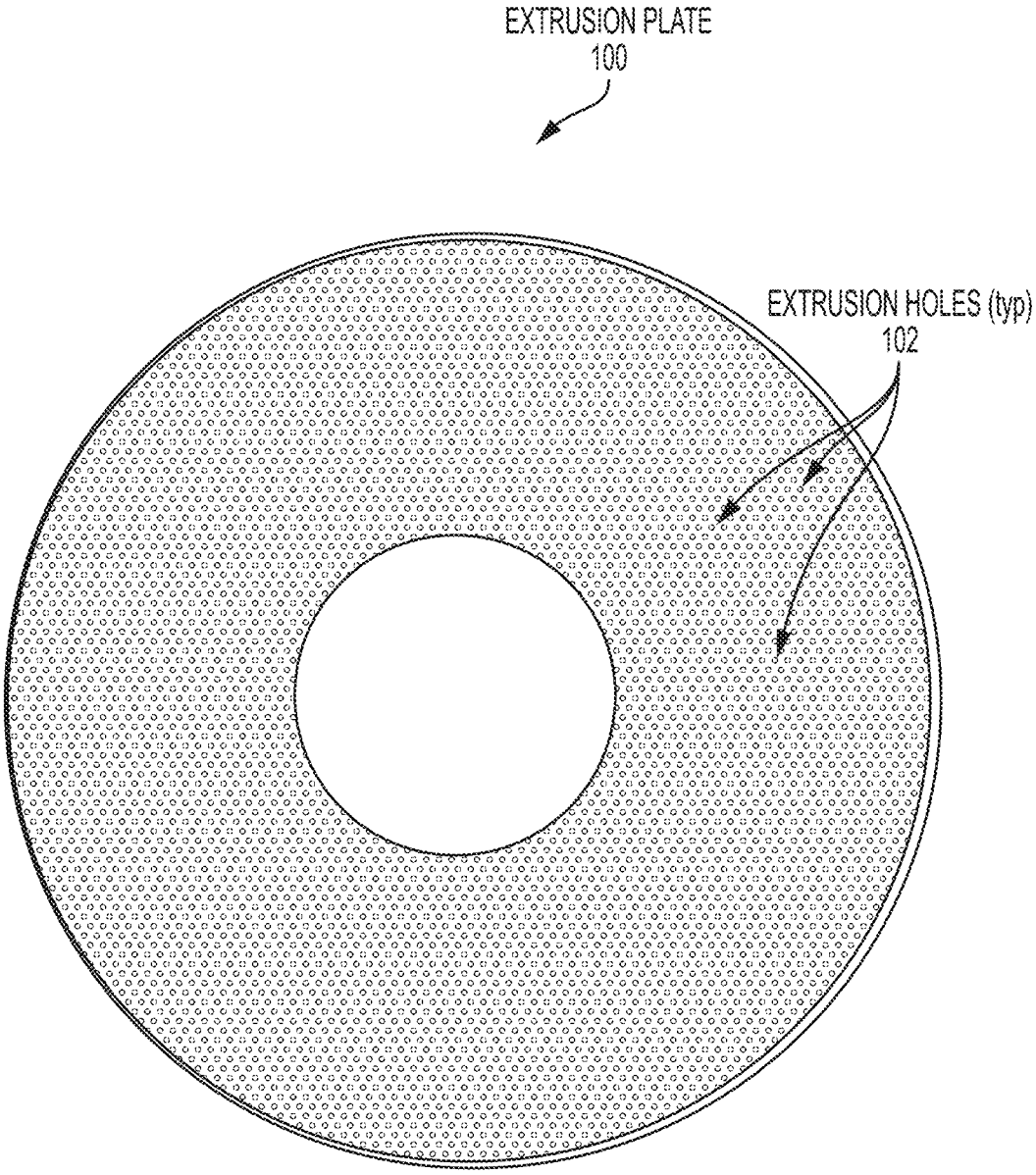
FIG. 5 illustrates the outlet side of the extrusion plate 100, which includes a plurality of extrusion holes 102.
Figure 6:
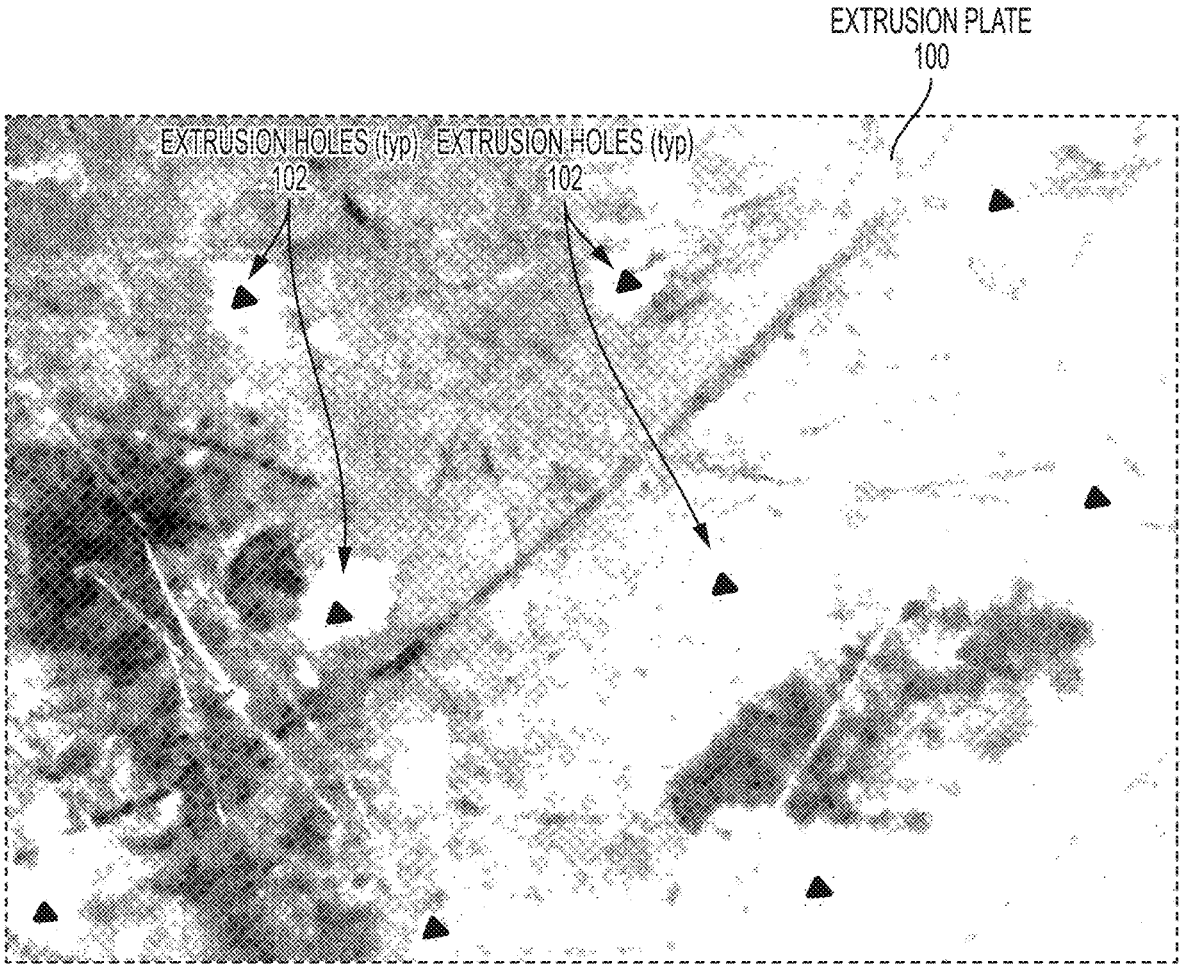
FIG. 6 is a close up partial view of that shown in FIG. 5, illustrating the extrusion holes 102 on the outlet side of the extrusion plate 100.

Similar to a bundle of the triangular bristles 21 described above, the bundle 1210 of star prism bristles 1122 can be manufactured by extruding the PBT material through the extrusion plate 100 (shown in FIG. 3). In other aspects, the star prism bristles 1122 can be formed from another material, such as, for example polybutylene terephthalate, polyethylene terephthalate (PET), nylon, Sorona®, and Natrafil®, as mentioned above. According to example aspects, the extrusion plate 100 can define a plurality of the extrusion holes 102 (shown in FIG. 5), and each of the extrusion holes 102 can define a star shape. For example, in a particular example aspect, each of the extrusion holes 102 can define a pentagram shape to form the illustrated pentagrammic prism bristles 1123. In other aspects, the extrusion holes 102 can define any other suitable star shape, such as a three- or four-pointed star, a hexagram, a heptagram, an octagram, or the like.

The Tipping Process as Applied to Star Prism Bristles

The tipping process can involve dipping the free ends 1175 of the star prism bristles 1122 in a chemical solution that can eat away at the bristles 1122 to create more pointed free ends 1175 thereof, resulting in the short tips 1220. For example, the chemical solution can be a sodium hydroxide (NaOH) solution. In some aspects, to prevent the bundle 1210 of star prism bristles 1122 from absorbing too much of the NaOH solution, the bundle 1210 of star prism bristles 1122 can be soaked in water before performing the tipping process. In example aspects, the bundle 1210 of star prism bristles 1122 can be soaked in room-temperature water for about 10 minutes. In other aspects, the bundle 1210 of star prism bristles 1122 can be soaked in water that is warmer or cooler than room temperature and/or can be soaked for more or less than 10 minutes. In still other aspects, the bundle 1210 of star prism bristles 1122 may not be soaked in the water before performing the tipping process.

CONCLUSION

Various modifications and variations can be made in the present invention without departing from the spirit or scope of the invention.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment. It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A brush assembly comprising:

a plurality of elongate primary brush bristles, each of the primary brush bristles defining a star-shaped transverse cross section, each of the primary brush bristles defining five substantially parallel outer edges and five substantially parallel inner edges extending along a length of the primary brush bristle; and a ferrule attached to the plurality of primary brush bristles.

2. The brush assembly of claim 1, wherein each of the primary brush bristles define five substantially parallel indentations extending along the length of the primary brush bristles.

3. The brush assembly of claim 2, wherein each of the indentations defines a substantially triangular cross section.

4. The brush assembly of claim 1, wherein each of the primary brush bristles defines ten bristle walls, each of the bristle walls extending between each adjacent pair of the inner and outer edges.

5. The brush assembly of claim 4, wherein each of the bristle walls extends along the length of the primary brush bristle.

6. The brush assembly of claim 4, wherein each of the bristle walls is angled inward toward a center axis of the primary brush bristle.

7. The brush assembly of claim 6, wherein:

a pair of the bristle walls are formed between an adjacent pair of the outer edges; and an indentation is formed between the pair of the bristle walls.

8. The brush assembly of claim 1, wherein the star-shaped transverse cross section defines five corner vertices and ten sides.

9. The brush assembly of claim 8, wherein:

the star-shaped transverse cross section defines a pentagram; and each of the vertices defines an interior vertex angle of 36°.

10. The brush assembly of claim 1, wherein each of the primary brush bristles is crimped to provide a wave.

11. The brush assembly of claim 1, wherein each of the primary brush bristles defines a free end configured for the application of cosmetics and a restrained end attached to the ferrule.

12. The brush assembly of claim 11, wherein each of the primary brush bristles defines a short tip at the free end.

13. The brush assembly of claim 1, further comprising a handle attached to the ferrule.

14. The brush assembly of claim 1, wherein each of the primary brush bristles comprises at least one of polybutylene terephthalate, polyethylene terephthalate, and nylon.

15. The brush assembly of claim 1, wherein:

the brush assembly further comprises a plurality of elongate secondary brush bristles;

each of the secondary brush bristles defines a transverse cross section having one of a rounded transverse cross section, a triangular transverse cross section, and a rectangular transverse cross section; and wherein the secondary brush bristles are intermixed with the primary brush bristles.

* * * * *